US005903709A

United States Patent [19]

Chen

[11] Patent Number: 5,903,709

[45] Date of Patent: May 11, 1999

[54] ELECTRODE-TYPE STEAM PRODUCTION DEVICE WITH AUTOMATICALLY CONTROLLED WATER INLET AND OUTLET VALVES

[75] Inventor: Hsi-Ming Chen, Taipei, Taiwan

[73] Assignee: Jeng Der Electrode Heater Co., Ltd., Taipei Hsien, Taiwan

[21] Appl. No.: 08/968,469

[22] Filed: Nov. 12, 1997

[51] Int. Cl.[6] ..... F22B 1/30; H05B 3/60

[52] U.S. Cl. ..... 392/325; 392/318; 122/4 A

[58] Field of Search ..... 392/325, 326, 392/337, 324, 329–332, 322, 318; 122/4 A, 13.2

[56] References Cited

U.S. PATENT DOCUMENTS

| | | | |
|---|---|---|---|
| 2,430,347 | 11/1947 | Lamphier | 392/325 |
| 2,612,592 | 9/1952 | Paulison, Jr. et al. | 392/325 |
| 3,682,141 | 8/1972 | Johansen | 392/325 |
| 3,760,775 | 9/1973 | Williams | 122/382 |
| 4,196,341 | 4/1980 | Williams | 392/325 |
| 4,430,555 | 2/1984 | Stokes | 392/325 |
| 4,439,669 | 3/1984 | Ryffel | 392/320 |

FOREIGN PATENT DOCUMENTS

| | | | |
|---|---|---|---|
| 412253 | 6/1946 | Italy | 392/325 |
| 715615 | 9/1954 | United Kingdom | 392/325 |

*Primary Examiner*—Teresa Walberg
*Assistant Examiner*—Daniel Leon Robinson
*Attorney, Agent, or Firm*—Rosenberg, Klein & Bilker

[57] ABSTRACT

Electrode elements directly heat water and with an electric current controller that is controlled by the heated water volume, which structurally enables immediate production of high temperature steam. The innovations of the invention here include: the utilization of an electric current controller than can be set at a certain value so that an electromagnetic water input valve is switched on or off at an appropriate time, which permits the maintaining of a fixed volume of water inside the water container and as such, the water inside the water container is not only prevented from overflowing, but at the same time forms an electric field with the electrode elements and is subsequently directly heated and thereby enables the production of high temperature steam in an extremely short period of time. Furthermore, the steam output port is designed with a pressure relief valve and a flow adjustment valve such that the high temperature steam produced rapidly escapes or is released in large volume safely and stably, which effectively ensures greater ease, convenience, multifunctionality and safety.

1 Claim, 3 Drawing Sheets

ELECTRODE-TYPE STEAM PRODUCTION DEVICE WITH AUTOMATICALLY CONTROLLED WATER INLET AND OUTLET VALVES

BACKGROUND OF THE INVENTION

The use of steam is extremely widespread and commonplace, with examples including power generation, cooking, ironing clothes, humidity adjustment and even medical treatment, therapeutics (such as steam baths) and so on. As for the conventional methods of supplying steam, the majority rely on a combustible fuel (such as wood, coal, gasoline and natural gas, etc.) or electrical heating, whereby water is first heated. However, regardless of whether a fuel or electrical means of heating water are employed, and although the heat source is in close proximity to the liquid being heated, the heat must travel through a medium (such as a water container or metal heating tubes), which is essentially indirect heating. Therefore, in addition to the shortcomings of poor heating efficiency and the wasting of energy resources, a certain amount of preheating time is required before the water being heated reaches a high temperature and it is therefore virtually impossible to produce steam in a predictable short period of time. In terms of practical usage, such approaches have disadvantages such as wasted time, inconvenience and low efficiency. Furthermore, when a user fails to notice that all the water in the water container has evaporated, and the fuel or electrical power source continues to provide heat, the drawback is not only a waste of energy, but the aforesaid water container, heating tubes and other heating components become damaged or a hazardous situation may result.

SUMMARY OF THE INVENTION

Therefore, the primary objective of the present invention is to provide a kind of electrode-type steam production device in which the steam output port of the water container is designed to be equipped with a pressure relief valve and a flow adjustment valve so that high temperature steam is supplied safely and consistently during both rapid and large volume release, and effectively ensures, in actual utilization, greater ease, convenience, multifunctionality and safety.

Another objective of the present invention is to provide a kind of electrode-type steam production device in which an electromagnetic water input valve is positioned at the bottom section of the water container such that when a timer, temperature controller, electric current controller and other electrical controller components are triggered, the water inside the aforesaid water container can be immediately emptied so the electrode elements no longer form an electrical field that continues to generate heat, which thereby effectively ensures safe usage and better economy with no wasted energy costs, while also preventing the damage and destruction of the components.

Yet another objective of the present invention is to provide a kind of electrode-type steam production device that is simple and convenient to clean, install and utilize. Furthermore, the present invention is economical enough to enable the fast high efficiency production of steam in a manner that is ensured to be rapid, multifunctional, stable and extremely practical in a structure that is both ideal and progressive.

DETAILED DESCRIPTION OF THE INVENTION

Figure 1:
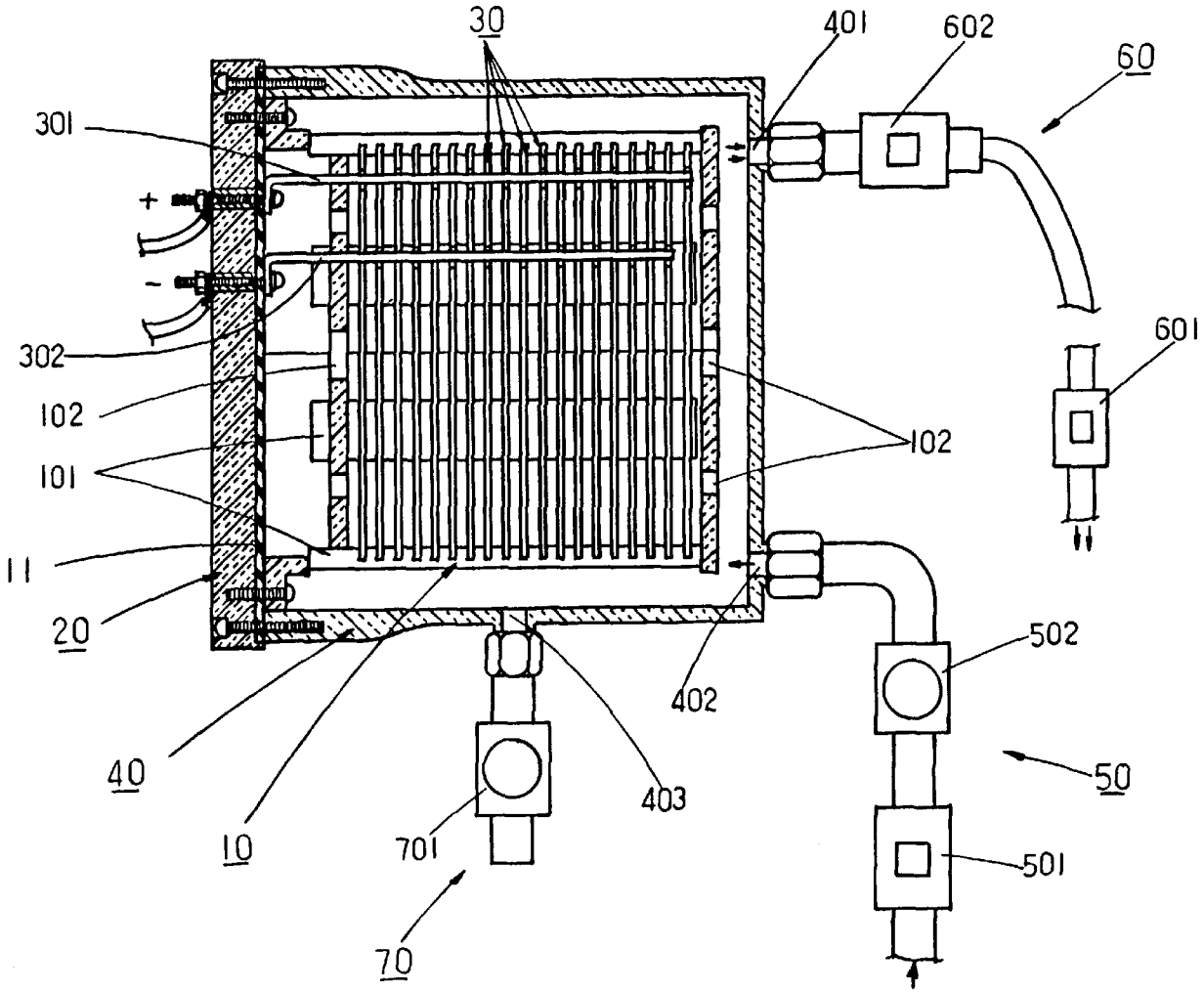
FIG. 1 is a cross-sectional view of the present invention.
Figure 2:
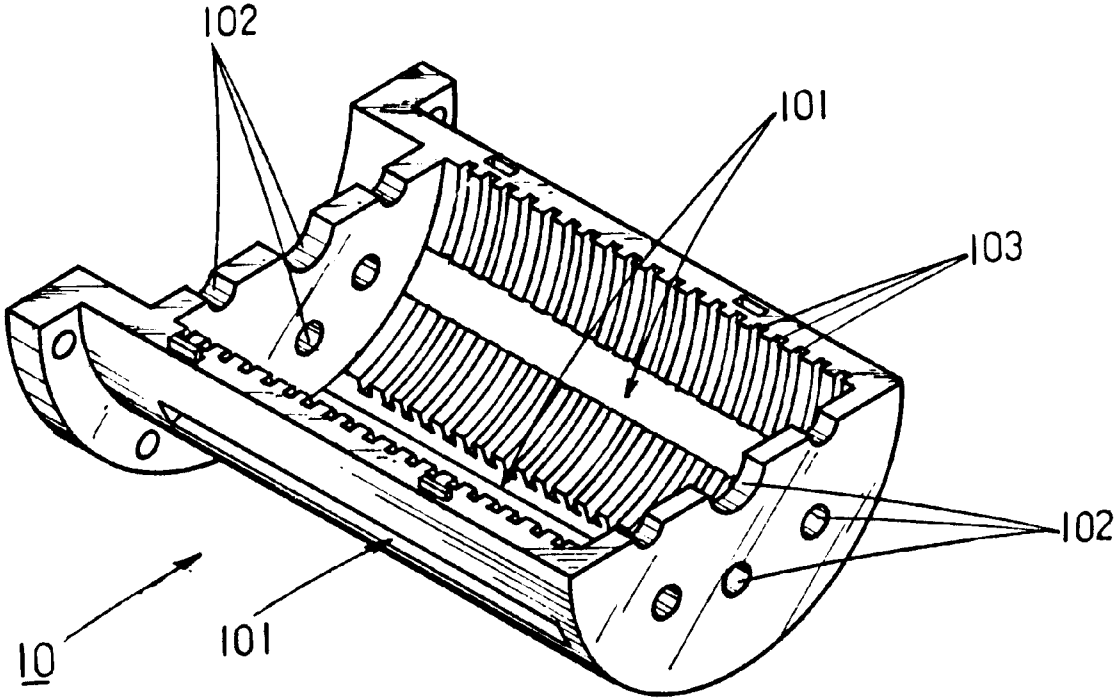
FIG. 2 is an isometric cross-sectional drawing of the electrode chamber of the present invention.
Figure 3:
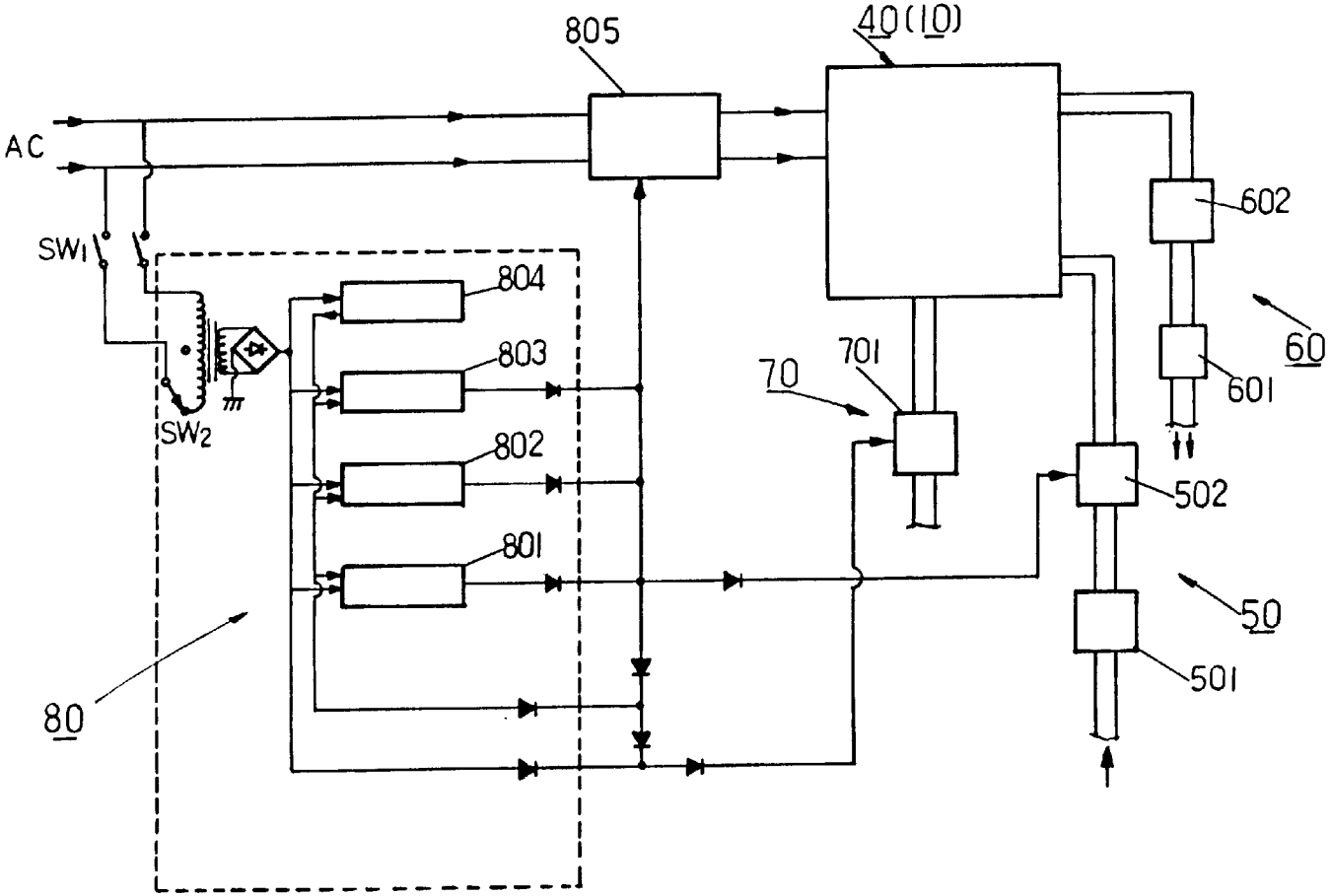
FIG. 3 is a block diagram of the present invention.

Referring to FIG. 1, FIG. 2 and FIG. 3, an electrode-type steam production device is shown that includes an electrode chamber (10) consisting of two halves constructed of a heat-resistant insulative material that are assembled together. A sealing gasket (11) is installed on a base (20). The electrode chamber has an outer surface that is perforated with a number of openings (101) and holes (102) according to a planned arrangement. The electrode chamber has an inner surface that has a number fixing slots (103) spaced apart at predetermined intervals.

A number of electrode elements (30) are provided that are constructed of a high temperature-resistant conductive material and are installed in the fixing slots (103) of the electrode chamber (10), with the odd-numbered and even-numbered elements respectively connected through the conductive wires (301) and (302) to the live wire and the ground wire of an electric power source. A water container (40) constructed of a heat-resistant insulative material is included, with the electrode chamber (10) being situated therein. The electrode chamber (10) maintains the sealing gasket (11) against the base (20). The water container (40) has a steam output port (401) at the top end thereof, and both a water input port (402) and a water output port (403) located at the bottom end of the water container. A water injection pipe (50) is connected to the water input port (402) positioned at the bottom end of the water container (40), and delivers water into the water container (40). The water in the container enables, in conjunction with the electrically powered electrode elements (30), the formation of a circuit that directly generates heat.

The water injection pipe (50) has a pressure reduction device (501) (such as a water input flow valve) and an electromagnetic water input valve (502). The pressure reduction device (501) is manually adjusted according to the water pressure of the installation site to thereby stably control the pressure of the water delivered to the water container (40), under all conditions. The opening and closing of electromagnetic water input valve (502) exercises control over water delivery. A steam output pipe (60) connected to the steam output port (401) of the water container (40) enables the emission of steam after the supplied water is heated. The steam output pipe is equipped with a flow adjustment valve (601) and a pressure relief valve (602). The flow adjustment valve (601) is manually adjusted to enable the steam to rapidly escape or be automatically released in large volume. The pressure relief valve (602) automatically relieves pressure when the steam pressure inside the water container (40) becomes excessive.

A water discharge pipe (70) is connected to the water output port (403) positioned at the bottom section of the water container (40). The water discharge pipe (70) is equipped with an electromagnetic water discharge valve (701) that empties water from the water container (40) at a required time. An electrical control system (80) includes an electric current controller (801), a temperature controller (802), a timer (803) and the reset key (804) of the controllers (801), (802) and (803).

The electric current controller (801) sets the electric current that toggles the operation of electromagnetic water input valve (502) of the water injection pipe (50). That arrangement enables water delivery into the water container (40) so that water being heated is maintained at a set volume. If the electric current to the electrode elements (30) heating the water, exceeds a set current value, or the temperature of the steam discharge relative to the room temperature exceeds a set value of the temperature controller (802), or the time period for heating the water reaches a set time value of the timer (803), then the electric current controller (801), the temperature controller (802) or the timer (803) of the controllers (801), (802), and (803) automatically switch off the switch controller (805) and the electromagnetic water input valve (502). Those controllers also automatically switch on the electromagnetic water discharge valve (701).

During utilization of the instant invention, when water is delivered into the water container (40) through the water injection pipe (50), the water also flows between each of the openings (101) and holes (102) of the electrode chamber (10). The water then flows across each of the electrode elements (30). As a result of the odd-numbered and even-numbered electrode elements (30) being respectively connected to the live wire and the ground wire of an electric power source, via the conductive wires (301) and (302), the molecular electrical conductivity through the water forms a circuit that enables the conducted electric current to directly heat the water. The direct heating of water achieves maximum heating efficiency. The electrode elements (30) are installed in particular positions in the electrode chamber (10), such that when no liquid is in the water container (40) or when the water level is not at the positions of the electrode elements (30), no current flows between electrode elements (30) and thereby effectively ensures safe utilization and electrical energy savings, while also preventing mechanical damage by a discontinuance of heat generation.

Furthermore, since the water contacts each of the electrode elements (30) while being delivered into the water container (40), the value of the conducted electrical current is related to the surface area of the electrode elements (30) in contact with the water (i.e., when the volume of water becomes greater, the electrical current value increases proportionally and if vice-versa, then the electric current decreased). Therefore, the current value at which the aforementioned electric current controller (801) is set (approximately 10 to 15 amperes for a general household utilization) appropriately controls the switching on and off of the electromagnetic water input valve (502) of the water injection pipe (50). That enables the water delivered into the water container (40) to be maintained at a constant set volume. None of the water delivered for heating overflows and, can be rapidly heated to the boiling point to produce high temperature steam. Furthermore, the electric current controller (801) is utilized to set the electric current value such that the level of electric current is based on the load when the electrode elements (30) are conducting electricity. Current controller (801) controls the switching on and off of the electromagnetic water input valve (502), without which the water being heated would boil excessively, resulting in a gradual reduction of the water level. When the electric current falls below the set value of the electric current controller (801), the electromagnetic water input valve (502) is automatically switched on or off at the appropriate time. When water is refilled to the volume level that causes the set value of the electric current controller (801) to be reached, then the electromagnetic water input valve (502) is immediately switched off, causing the inflow of water to remain at the set volume, which not only prevents overflow, but also permits boiling to occur in a relative brief span of time to thereby provide a stable supply of high temperature steam.

Furthermore, as the steam output pipe (60) is designed with a flow adjustment valve (601) and a pressure relief valve (602), when the steam generated by the direct heating thereof travels through the steam output pipe (60), the operation of the flow adjustment valve (601) enables the selection of whether the steam rapidly escapes or is automatically released in large volume at the appropriate time. Due to the operation of the pressure relief valve (602), when the steam pressure inside the water container (40) becomes too great, the excess is discharged at the appropriate time, which thereby provides for safe utilization.

Still further, the electrical control system (80) has an electric current controller (801), a temperature controller (802) and a timer (803) that individually trigger the switch controller (805), the electromagnetic water input valve (502) and the electromagnetic water discharge valve (701). Therefore, when the water heating electrical current exceeds the set value of the electric current controller (801), or the discharge steam temperature exceeds the set temperature value of the temperature controller (802), or the water heating period reaches the set time value of the timer (803), the switch controller (805) and the electromagnetic water input valve (502) are automatically switched off, while the electromagnetic water discharge valve (701) is automatically switches on. When all the water in water container (40) has been totally discharged, such immediately terminates heating, ensuring safety. Of course, since each electrode element (30) can be installed perpendicular to that shown in the Figures, the water residue remaining after water heating can e conveniently removed by the water discharge pipe (70) and drained out through the openings (101) at the bottom section of the electrode chamber (10).

What is claimed is:

1. An electrode-type steam production device, comprising:

an enclosed water container formed of a thermally insulative material;

an electrode chamber formed of a thermally insulative material and secured within a cavity of said water container, said electrode chamber having an internal cavity defined by a longitudinally extended cylindrical wall and a pair of end walls formed at opposing ends of said cylindrical wall, said cylindrical wall and said pair of end walls each having a plurality of openings formed therethrough to provide fluid communication between said internal cavity of said electrode chamber and a portion of said water container external to said electrode chamber, said cylindrical wall having a plurality of fixing slots formed in an interior surface thereof and disposed in longitudinally spaced relationship, said electrode chamber including a plurality of electrode elements respectively disposed in said fixing slots and alternatingly connected to respective conductors of a power line;

a water injection pipe coupled in fluid communication with said cavity of said water container, said water injection pipe including (a) an electromagnetic input valve for enabling and terminating water flow into said cavity of said water container responsive to a first control signal, and (b) a pressure reduction device located down stream of said electromagnetic input valve for controlling a pressure level of water delivered to cavity of said water container;

a water discharge pipe coupled in fluid communication with a lower portion of said cavity of said water container, said water discharge pipe including an electromagnetic water discharge valve for emptying said cavity of said water container responsive to a second control signal;

a steam outlet pipe coupled in fluid communication with an upper portion of said cavity of said water container for discharge of steam therefrom, said steam outlet pipe including (a) a pressure relief valve for relieving excessive pressure from within said cavity of said water container, and (b) a flow adjustment valve located down stream of said pressure relief valve for controlling a volume of steam being discharged;

a switch controller coupled between said electrode elements and the conductors of the power line for disconnecting said electrode elements from the conductors of the power line responsive to said first control signal; and, electrical control means having a first output coupled to both said switch controller and said electromagnetic input valve for coupling said first control signal thereto and a second output coupled to said electromagnetic water discharge valve for coupling said second control signal thereto, said second control being derived from said first control signal, said electrical control means including:

(a) an electric current controller for monitoring an electric current flowing through said electrode elements, said electric current controller outputting said first control signal responsive to said monitored electric current exceeding a predetermined current value;

(b) a temperature controller for monitoring a temperature value of said steam being discharged, said temperature controller outputting said first control signal responsive to said monitored temperature exceeding a predetermined temperature value; and, (c) a timer for timing a heating period of water in said water container and outputting said first control signal responsive to an expiration of said heating period.

* * * * *